US007309823B2

(12) United States Patent
Yamayoshi et al.

(10) Patent No.: US 7,309,823 B2
(45) Date of Patent: Dec. 18, 2007

(54) STRING-BOUNDING PREVENTING STRUCTURE FOR PIANO

(75) Inventors: Toshio Yamayoshi, Hamamatsu (JP); Satoshi Inoue, Hamamatsu (JP); Tomonori Ichikawa, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 134 days.

(21) Appl. No.: 11/047,044

(22) Filed: Jan. 31, 2005

(65) Prior Publication Data

US 2005/0172781 A1 Aug. 11, 2005

(30) Foreign Application Priority Data

Feb. 6, 2004 (JP) ..... 2004-030985

(51) Int. Cl.
*G10C 3/04* (2006.01)

(52) U.S. Cl. ..... 84/214; 84/297 R

(58) Field of Classification Search ..... 84/214, 84/213, 297 R

See application file for complete search history.

(56) References Cited

U.S. PATENT DOCUMENTS 500,562 A * 7/1893 Couchois ..... 84/214
550,268 A * 11/1895 Hafer et al. ..... 84/214
4,276,805 A * 7/1981 Kaneko ..... 84/458

* cited by examiner

*Primary Examiner*—Lincoln Donovan
*Assistant Examiner*—Jianchun Qin
(74) *Attorney, Agent, or Firm*—Koda & Androlia

(57) ABSTRACT

A plurality of strings are stretched over a frame, constituting an overall framework of a body of a piano, with their respective rear-end engaging rings engaged by corresponding pins provided on the frame. There is also provided a string-bounding preventing member that, in case any one of the strings snaps or breaks, prevents the broken string from disengaging from the corresponding pin to bound violently away from the pin. The string-bounding preventing member is, for example, a strap member that is passed through the respective engaging rings to thereby connect together the strings. The string-bounding preventing member allows the broken string to be left connected with the other strings and hence stay in place on the frame without bounding.

2 Claims, 4 Drawing Sheets

STRING-BOUNDING PREVENTING STRUCTURE FOR PIANO

BACKGROUND OF THE INVENTION

The present invention relates generally to pianos, and more particularly to an improvement in pianos for preventing a tensioned string from quickly and violently bounding when the string snaps, i.e. breaks.

As well known, acoustic pianos have a plurality of tensioned or stretched strings. Grand pianos, for example, generally include about 230 strings stretched under tension, of which the strings for a bass range are each in the form of a single steel core wire with a copper wire wound thereon (i.e., in the form of a "wound wire") while the strings for mid and treble ranges are each in the form of a core wire with no winding wire (i.e., in the form of an "unwound wire"). These strings are stretched over a frame (iron board), constituting an overall framework of the body of the grand piano, under uniform tension (e.g., about 90 kg) generally in a direction from the front (i.e. keyboard side) toward the rear (i.e., in a front-to-rear direction) of the piano. For efficient arrangement of the over-200 strings within the piano body, the strings for the bass range are positioned over and obliquely across the other strings (i.e., strings for the mid and treble ranges); namely, the strings (wound wires) for the bass range are positioned at a higher level than the other strings.

Mounting structure per string is briefed below. The string has a rear end portion caught or engaged by a projecting pin provided on a rear frame section, and a front end portion wound on a tuning pin provided on a front frame portion (so-called "pin plate"). As also well known, the piano is tuned by the respective tuning pins of the strings being turned with a tuning hammer. FIG. 4 is a schematic sectional view taken along a front-and-rear direction of the piano, which extractively shows how the rear end portion of the string is fixed in place on the frame. In FIG. 4, reference numeral 1 represents a side plate forming a rear side surface of the piano body, and 2 represents a soundboard. Frame pin 4 is provided on and projects upwardly from the upper surface of the frame 3. The string (wound wire in the illustrated example) 5 has an engaging ring formed or provided on its rear end for engagement with the frame pin 4. Namely, the string 5 is fixed at the rear end by the frame pin 4; that is, the rear-end engaging ring is engaged around and held by the frame pin 4. By winding up the front end portion of the string 5 on the tuning pin with the rear end portion (i.e., engaging ring) engaged by the frame pin 4, the string 5 is imparted with a tensile force or tension in the front-and-rear direction of the piano. As shown, the frame pin 4 supporting the rear end portion of the string 5 on the frame 3 is slightly inclined toward the rear of the piano, allowing for the tension imparted to the string 5.

However, the piano string 5 may snap, i.e. break, due to aging, rust, excessive tension imparted thereto, etc. Typically, the string 5 tends to snap or break at or around a point thereof hit by a corresponding hammer, i.e. near its front end. As noted above, a great tensile force normally acts on the stretched string 5 in the front-and-rear direction, and the string 5 is kept in the stretched or tensioned state merely with the rear-end engaging ring engaged around the frame pin 4 that is slightly inclined rearward. Thus, in case the string 5 breaks at a point near its front end, the portion of the string 5 located rearward of the broken point would be quickly tugged with a great force toward the rear of the piano, as a reaction resulting from a sudden loss of the so-far imparted tension. In such a case, the engaging ring of the string 5 may easily slip out of the engagement with (i.e., disengage from) the frame pin 4 and bound (leap) quickly and violently away from the initially-stretched position, sometimes even beyond the rear side plate 1 or outside the piano. The thus-bounding broken string 5 often hits outer covering members of the piano, such as the rear side plate 1 and roof plate, with a very strong force, thereby damaging the outer covering members. Particularly, if the broken string 5 is a wound wire of the bass range located at a higher level, the string 5 is more likely to damage the rear side plate, roof plate, etc. because there is provided no particular member for preventing the violent bounding of the broken string 5. Further, because the grand piano is often used with the roof plate kept in its raised or open position and thus the interior of the instrument body exposed to the outside, even external flaws thus caused in the inner surfaces of the rear side plate, roof plate, etc. are undesirable in that they aesthetically impair the appearance of the grand piano. Furthermore, because the outer covering members, such as the rear side plate and roof plate, are not readily replaceable, it is also desirable to prevent damages to these members as effectively as possible.

SUMMARY OF THE INVENTION

In view of the foregoing, it is an object of the present invention to provide a technique which, in case a string of a piano snaps or breaks, can effectively prevent, with a simple construction, outer covering members of the piano, such as a side plate, from being damaged due to bounding of the broken string.

The present invention provides a string-bounding preventing structure for a piano having a structure for stretching a plurality of strings over a frame, each of the strings having an engaging ring provided at one end thereof and engaged by a corresponding one of pins provided on the frame, said string-bounding preventing structure comprising a member that, when any of the strings stretched via said structure for stretching breaks, prevents the broken string from disengaging from the pin to bound away from the pin.

In case any one of the strings snaps or breaks, the member of the string-bounding preventing structure prevents the engaging ring of the broken string from disengaging from the pin to bound violently away from the pin or bounding outside the piano. Thus, the present invention can effectively prevent the outer covering members, such as side and roof plates, from being damaged due to bounding of the broken string.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

Sections (a) to (c) of FIG. 1 are upper perspective views of a string-mounted portion of a grand piano, which particularly show a string-bounding preventing member in accordance with a first embodiment of the invention;

Figure 2:
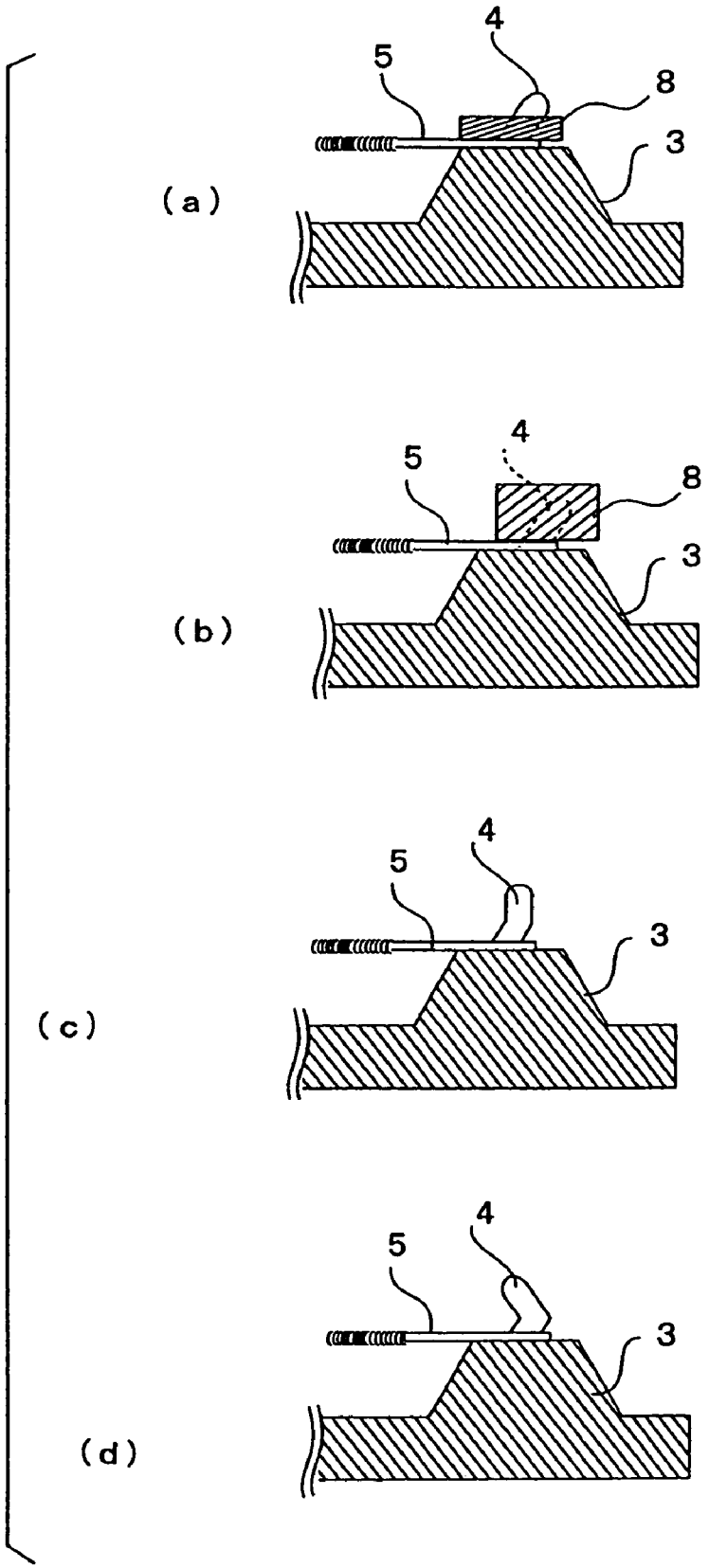
Figure 3:
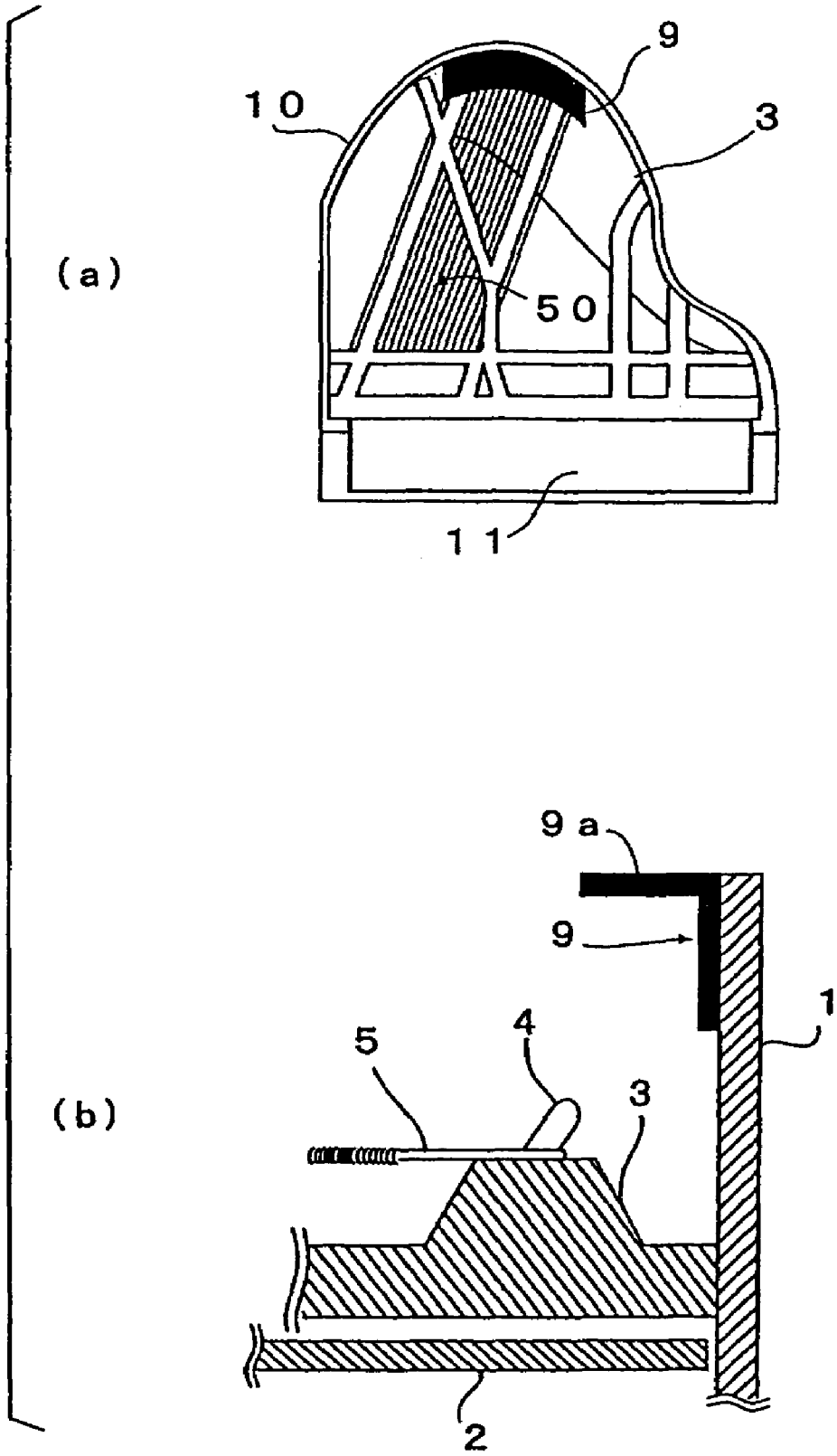
Figure 4:
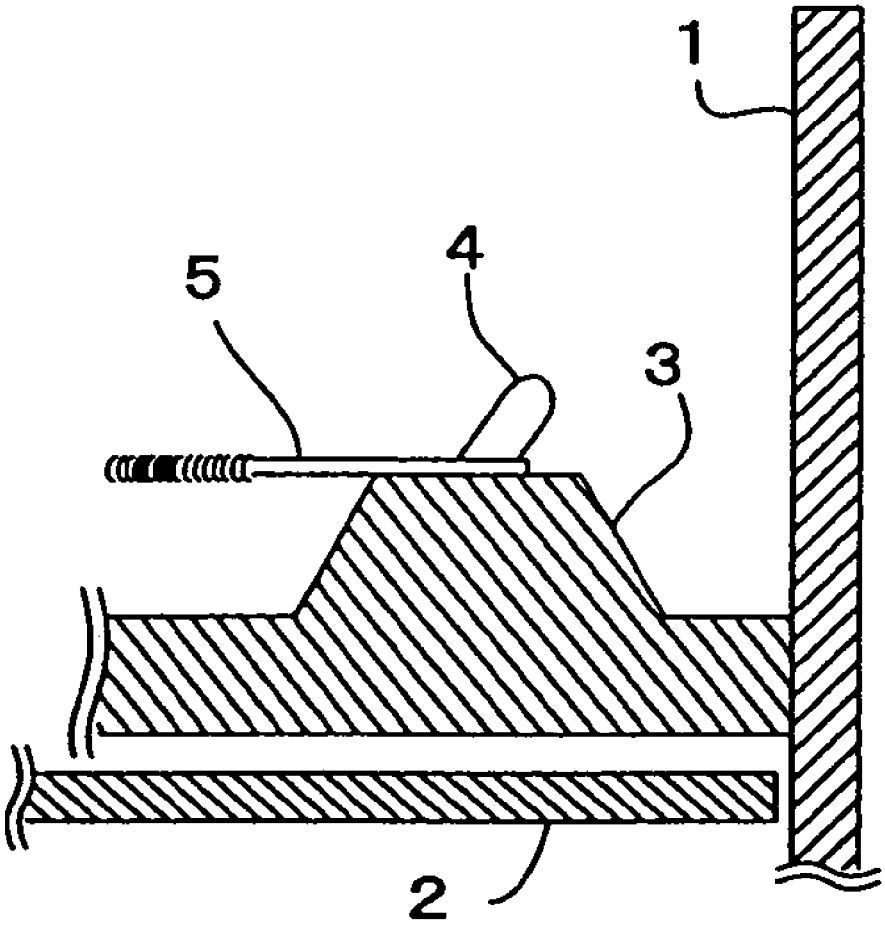
( PRIOR ART ) F I G. 4

Sections (a) to (d) of FIG. 2 are schematic sectional side views of a string-mounted portion of a grand piano, which particularly show a string-bounding preventing member in accordance with a second embodiment of the invention;

Section (a) of FIG. 3 is a schematic top plan view of a grand piano employing a string-bounding preventing member in accordance with a third embodiment of the invention, and section (b) of FIG. 3 is a schematic sectional side view of the grand piano employing the string-bounding preventing member; and FIG. 4 is a schematic sectional view taken along a front-and-rear direction of the piano, which extractively shows how a rear end portion of a string is fixed in place.

DETAILED DESCRIPTION OF THE INVENTION

First embodiment of the present invention will be described with reference to FIG. 1, where the same reference numerals as in FIG. 4 represent elements similar to those in FIG. 4.

Figure 1:
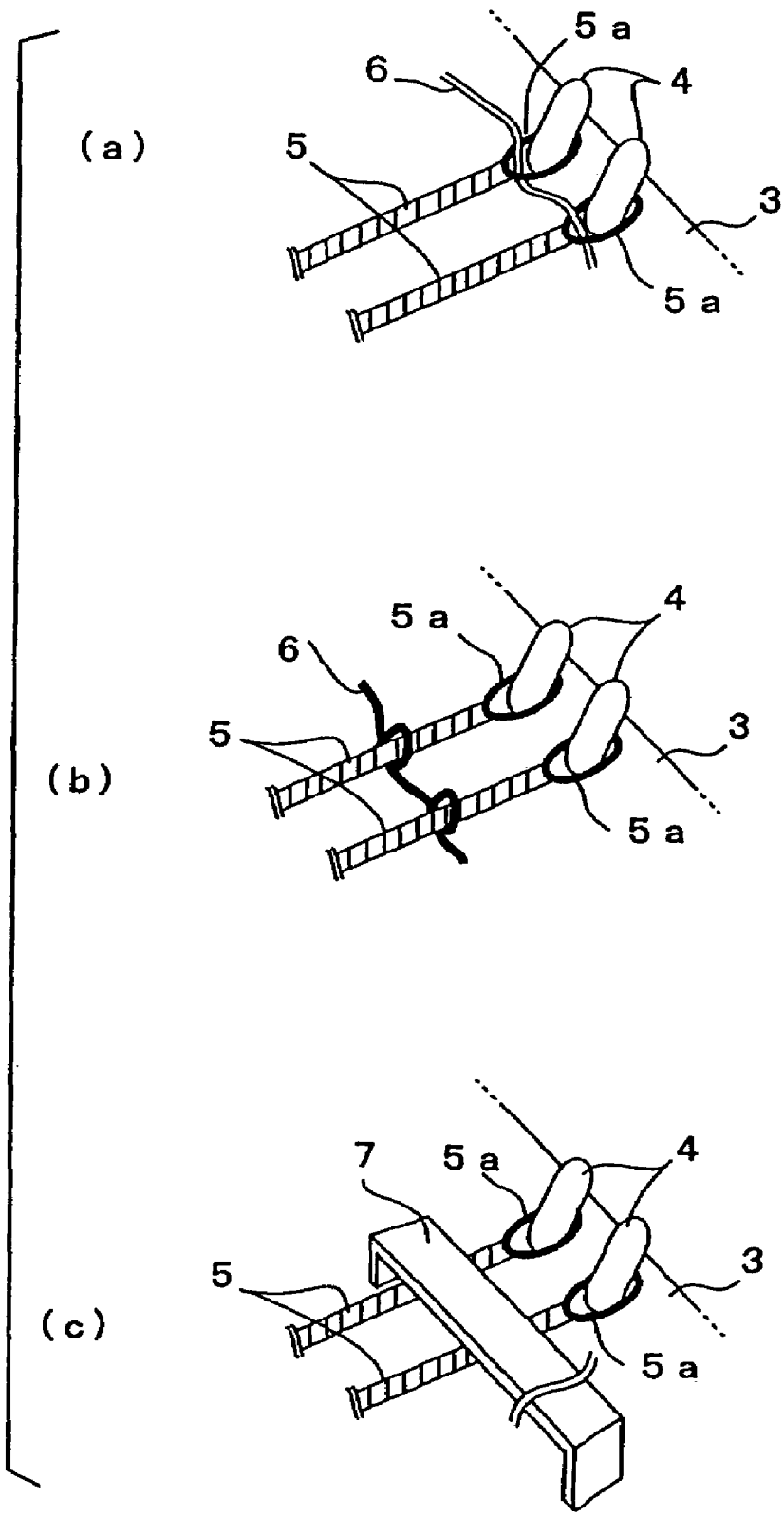

Sections (a) and (b) of FIG. 1 are enlarged views extractively showing principal portions of a grand piano in accordance with the first embodiment of the present invention, More specifically, sections (a) and (b) of FIG. 1 are schematic upper perspective views of the piano, which shows a frame pin 4 provided on a rear frame portion 3 of the grand piano and a string 5 secured at its rear end portion to the frame pin 4. In this embodiment, a structure for stretching each of the strings 5 on the body of the grand piano is similar to that shown in FIG. 4, and hence illustration of the frame and other mounting members is omitted here to avoid unnecessary duplication. The string 5 has a rear-end engaging ring 5*a* engaged around and held by the frame pin 4 so that it is secured on the frame 3 in a tensioned condition. In the instant embodiment, a strap member 6 is employed as a member to prevent bounding of the string when the string 5 accidentally snaps, i.e. breaks. In the illustrated example of (a) of FIG. 1, the strap member 6 is passed through the respective engaging rings 5*a* of the strings 5 to connect together the strings 5. Thus, even when any one of the strings 5 has broken and slipped out of the engagement with (i.e., disengaged from) the frame pin 4, the broken string 5, which is connected with the other strings 5 via the strap member 6, can stay in place on the frame 3 without violently bounding due to a sudden loss of the tension. In this way, even when the string 5 has accidentally snapped or broken, the instant embodiment can reliably prevent undesired violent bounding of the string 5, which thus can prevent outer covering members of the piano, such as side and roof plates, from being damaged by the broken string 5.

In the illustrated example (a) of FIG. 1, the plurality of strings 5 are connected with one another by the strap member 6 passed through the respective engaging rings 5*a* of the strings 5. Section (b) of FIG. 1 shows another example where the plurality of strings 5 are connected with one another by the strap member 6 wound around each of the strings 5 one or more times neat the rear end. Thus, even when the string 5 has snapped or broken, this example can reliably prevent undesired violent bounding of the string 5, in a similar manner to the example of section (a).

Note that the strap member 6 may be made of any suitable material as long as the material has a sufficient strength for effectively preventing violent bounding of the broken string 5. Further, whereas the examples of the strap member 6 have been shown and described as employing the single strap member 6, two or more strap members 6 may be employed.

In the examples of sections (a) and (b) of FIG. 1, undesired bounding of any broken string 5 can be effectively prevented with an extremely simple construction that the plurality of strings 5 are connected together or with one another by means of the strap member 6. Further, because it just suffices to fasten the strap member 6 to the rear end portions of the strings 5, the embodiment of the present invention will never aesthetically impair the attractiveness of the interior of the grand piano.

Section (c) of FIG. 1 is a schematic view showing another structural example of the string-bounding preventing member which, even when the broken string 5 has slipped out of the engagement with the frame pin 4, functions to allow the broken string 5 to stay in place on the frame 3 without bounding. In the example of section (c) of FIG. 1, a bridge-shaped cover member 7 is employed to cover upper portions of a plurality of strings 5 in a non-contact fashion, so as to function as a member to prevent bounding of any broken string 5. For example, the cover member 7 may be secured on the frame 3 by screwing, and it may be sized or constructed to cover all of the strings 5 to be prevented from violent bounding in case of string breakage. Specifically, the cover member 7 is positioned astride the strings 5 near their rear end portions. In case any of the strings 5 snaps or breaks, the cover member 7 can effectively prevent bounding of the broken string 5 and allows the broke string 5 to stay on the frame 3. Note that the cover member 7 may be formed of any suitable material, such as metal or resin.

Now, a description will be given about a second embodiment of the string-bounding preventing member, which is constructed to positively prevent a broken string 5 from slipping out of the engagement with (i.e., disengaging from) the frame pin 4, with reference to sections (a) to (d) of FIG. 2. Sections (a) to (d) of FIG. 2 are schematic sectional side views of the piano, which extractively shows how the rear end portion of the string 5 is fixed in place. In section (a) of FIG. 2, a pressing block 8 is mounted on the rearwardly-inclined frame pin 4, which is a plate-shaped member of any suitable material, such as rubber or resin. The pressing block 8 has a mounting hole 8*a* for insertion therein of the frame pin 4, and the mounting hole 8*a* is formed obliquely, relative to the upper and lower surfaces of the block 8, to agree with an inclined angle of the frame pin 4. With the string 5 engaged by the frame pin 4, the pressing block 8 is placed around the frame pin 4 from above to thereby press the rear end portion (engaging ring 5*a*) of the string 5 from above against the frame 3. In this way, in case the string 5 snaps or breaks, the pressing block 8 reliably keeps pressing the rear end portion (engaging ring 5*a*) so that the string 5 can be prevented from disengaging from the frame pin 4, thereby effectively forestalling bounding of the broken string 5 away from the pin 4 and frame 3. Note that one pressing block 8 may be constructed to simultaneously press a plurality of the strings 5; namely, one pressing block 8 may be formed into an elongated shape and may have a plurality of the mounting holes 8*a* formed in accordance with a pitch of the frame pins 4 on the frame 3. Further, the pressing block 8 may be formed to have a width suitable for reliably pressing the string(s) 5 against the frame 3. The string-bounding preventing member in the form of such a pressing block 8 is advantageous in that it can be attached to and removed from the piano body with extreme ease.

The pressing block 8 illustrated in section (a) of FIG. 2 has a relatively small thickness (i.e., low profile in the figure) and has a through-hole as the mounting hole 8*a*.

Therefore, when the pressing block 8 is mounted in place, an upper end portion of the frame pin 4 projects beyond the upper surface of the pressing block 8.

Section (b) of FIG. 2 illustrates a modified example of the pressing block 8 of section (a), and the modified pressing block 8 has a relatively great thickness (i.e., relatively high profile in the figure). Therefore, when the pressing block 8 is mounted in place, the frame pin 4 is embedded in the mounting hole 8*a* without projecting beyond the upper surface of the pressing block 8.

The thickness, horizontal width, sectional shape, material, etc, of the pressing block 8 as one form of the string-bounding preventing member may be other than the above-mentioned, as long as the pressing block 8 is capable of firmly holding the string(s) 5 on the frame 3. Instead of one pressing block 8 being mounted for a plurality of the frame pins 4, a separate pressing block 8 may be mounted for each of the frame pins 4.

Sections (c) and (d) of FIG. 2 are sectional views showing still other structural examples of the string-bounding preventing technique for preventing a broken string 5 from disengaging from the frame pin 4 and thereby avoid bounding of the broken string 5 away from the pin 4 and frame 3. Specifically, the string-bounding preventing techniques illustrated in sections (c) and (d) of FIG. 2 are characterized by bending a distal end portion of the frame pin 4 in such a manner that a broken string 5 can be prevented, by the bent distal end portion, from disengaging from the frame pin 4.

As set forth above, each of the frame pins 4 is slightly inclined toward the rear of the piano. When the string 5 has snapped or broken, the broken string 5 would be forced out of the engagement with the frame pin 4 rearwardly along the inclined surface of the pin 4; therefore, in the prior art, the broken string easily disengaged from the frame pin. The illustrated examples of sections (c) and (d) of FIG. 2 are, however, designed to avoid the problem of the conventionally-known technique, by just bending, through an appropriate angle, the distal end portion of the frame pin 4 back toward the front of the piano. More specifically, the illustrated example of FIG. 2, section (c) is characterized by bending back the distal end portion of the frame pin 4 to project upward in a substantially vertical direction, while the illustrated example of sections (d) is characterized by bending back the distal end portion of the frame pin 4 into a hook shape directed toward the front of the piano. With the distal end portion of the frame pin 4 thus bent back toward the front of the piano, the broken string 5, forced toward the rear of the piano as a reaction resulting from a sudden loss of the tension, can be effectively prevented from disengaging from the frame pin 4, Note that the distal end portion of the frame pin 4 may be bent sideways or toward the rear of the piano, instead of being bent toward the front of the piano. For example, the distal end portion of the frame pin 4 may be bent toward the rear of the piano in a substantial horizontal direction. In this way, when any of the strings 5 has broken and is subjected to a force causing the rear-end engaging ring 5*a* of the broken string 5 to slip along the axis of the frame pin 4, the rear-end engaging ring 5*a* abuts against the vertically-bent-back distal end portion of the frame pin 4 and thus can be reliably prevented from disengaging from the frame pin 4. Namely, the string-bounding preventing members of the present invention, which is of the type intended to prevent the broken string 5 from disengaging from the frame pin 4, may be constructed to merely buffer the force that would cause the broken string 5 to bound as a reaction of a sudden loss of the so-far imparted tension, so as to prevent the disengagement from the frame pin 4.

Now, a description will be given about a third embodiment of the string-bounding preventing member, with reference to sections (a) and (b) of FIG. 3. Section (a) of FIG. 3 is a schematic upper perspective view of the piano employing the third embodiment. In section (a), reference numeral 10 represents the body of the piano, 11 a keyboard disposed on a front portion of the piano body 10, and 50 a group of the strings (wound wires) for the bass range which are located at a higher level than the strings for the other ranges. Section (b) of FIG. 3 is a schematic sectional side view extractively showing in enlarged scale how the rear end portion of the string 5 is fixed in place. As illustrated in section (a), a guard (or fence) member 9 is provided on the inner surface of the rear side plate 1 of the piano over a range where the string group 50 is positioned. As illustrated in section (b), the guard (or fence) member 9, which has a substantial "L" sectional shape, has an upper plate portion (flange or eave portion) 9*a* projecting inwardly from the inner surface of the side plate 1. Thus, even when the broken string 5 is forced to slip off and bound away from the frame pin 4, it bumps onto the guard member 9 and can be prevented from bounding further. Namely, the guard member 9, onto which the broken string 5 bumps, can prevent the broken string 5 from jumping beyond the rear side plate 1, thereby minimizing the undesired bounding of the string 5. In this way, the third embodiment can effectively prevent damages to the other covering members.

Note that the width of the upper plate portion 9*a* of the guard member 9, i.e. how far the upper plate portion 9*a* projects into the interior of the instrument, may be chosen as desired as long as the guard member 9 can effectively prevent the broken string from bounding outside the instrument.

Also note that the above-described first and third embodiments of the string-bounding preventing member of the type capable of preventing a broken string from bounding outside (i.e. capable of retaining the broken string on the frame) may each be constructed in any desired manner as long as it can buffer the bounding of the broken string. Furthermore, the above-described first to third embodiments of the string-bounding preventing member may be applied either to only some of the strings, such as the strings (wound wires) for the bass range that are positioned at a level higher than the other strings, or to all of the strings. Furthermore, whereas the first to third embodiments of the invention have been described as applied to grand pianos, the string-bounding preventing member of the present invention may also be applied to upright pianos.

What is claimed is:

1. A string-bounding preventing structure for a piano having a structure for stretching a plurality of strings over a frame, each of the strings having an engaging ring provided at one end thereof and engaged by a corresponding one of pins provided on the frame, said string-bounding preventing structure comprising a member that, when any of the strings stretched via said structure for stretching breaks, prevents the broken string from disengaging from the pin to bound away from the pin wherein said member includes a strap connecting between the engaging rings of said plurality of strings.

2. A string-bounding preventing structure for a piano having a structure for stretching a plurality of strings over a frame, each of the strings having an engaging ring provided at one end thereof and engaged by a corresponding one of pins provided on the frame, said string-bounding preventing structure comprising a member that, when any of the strings stretched via said structure for stretching breaks, prevents the broken string from disengaging from the pin to bound away from the pin wherein said member includes a strap connecting between said plurality of strings.

* * * * *